US008182272B2

(12) United States Patent
Ooi

(10) Patent No.: US 8,182,272 B2
(45) Date of Patent: May 22, 2012

(54) ELECTRICAL CONNECTOR

(75) Inventor: Tetsuya Ooi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/858,697

(22) Filed: Aug. 18, 2010

(65) Prior Publication Data

US 2011/0045708 A1 Feb. 24, 2011

(30) Foreign Application Priority Data

Aug. 18, 2009 (JP) ..... 2009-189151

(51) Int. Cl.
*H01R 12/00* (2006.01)

(52) U.S. Cl. ..... 439/74; 439/660

(58) Field of Classification Search ..... 439/74, 439/660

See application file for complete search history.

(56) References Cited

U.S. PATENT DOCUMENTS

| | | | | |
|---|---|---|---|---|
| 7,320,606 | B2 * | 1/2008 | Midorikawa | 439/74 |
| 7,344,387 | B2 * | 3/2008 | Shiroyama | 439/74 |
| 7,410,364 | B2 * | 8/2008 | Kishi et al. | 439/74 |
| 7,748,993 | B2 * | 7/2010 | Midorikawa et al. | 439/74 |
| 7,833,024 | B2 * | 11/2010 | Takeuchi et al. | 439/74 |
| 2009/0029572 | A1 * | 1/2009 | Midorikawa | 439/74 |
| 2009/0305528 | A1 * | 12/2009 | Hirata et al. | 439/74 |

FOREIGN PATENT DOCUMENTS

| | | |
|---|---|---|
| JP | 10-055856 | 2/1998 |
| JP | 3108400 U | 2/2005 |
| JP | 2009-032425 | 2/2009 |

OTHER PUBLICATIONS

Office Action for Japanese Patent Application 2009-189151, Japan Patent Office, Jun. 29, 2011.

* cited by examiner

*Primary Examiner* — Hien Vu
(74) *Attorney, Agent, or Firm* — Kubotera & Associates, LLC

(57) ABSTRACT

An electrical connector includes a housing to be disposed on a circuit board, a receiving recess portion formed in the housing for receiving a mating connector, and a terminal arranged in the housing. The terminal includes a U-shape portion, an extending portion extending outside the receiving recess portion a first sidewall facing outside, and a connecting portion. The U-shape portion includes a first arm portion and a second arm portion. The first arm portion is fitted along the sidewall and the second arm portion is fitted along a second sidewall. The first arm portion and the second arm portion include locking portions for being fixed against an inner surface of the receiving recess portion, respectively. The extending portion is arranged to be away from the first sidewall to form a space in between.

5 Claims, 6 Drawing Sheets

ELECTRICAL CONNECTOR

BACKGROUND OF THE INVENTION AND RELATED ART STATEMENT

The present invention relates to an electrical connector. More specifically, the present invention relates to an electrical connector attached to a circuit board.

A conventional electrical connector (a connector) is disclosed in Patent Reference. The connector for a circuit board in Patent Reference includes a housing (an insulating main body) formed with a recess portion for receiving a mating connector opening in an upper direction and a plurality of terminals held in the housing.

The housing includes a convex portion situated in a central portion of the recess portion of the housing. The convex portion has an island shape and protrudes in the upper direction from a bottom wall portion as a wall portion. The recess portion surrounds the convex portion circularly upon being viewed from the upper direction. A plurality of the terminals is disposed in both ends of the convex portion along a sidewall of the housing to be symmetrical relative to the convex portion.

Patent Reference: Japanese Utility Model Publication No. 3108400

The terminal has a lateral S-shape and is made by punching a metal plate while a plate surface thereof is maintained. The terminal includes a contacting arm portion extending along the wall portion of the convex portion in the recess portion, and a holding arm. The holding arm has an upside-down U-shape including two leg portions extending over an upper end of the sidewall of the housing then to a lower direction. The terminal further includes a combining portion for combining a lower end of the contacting arm portion and a lower end of one of the leg portions, and a connecting portion (a soldered portion). The connecting portion extends outside from a lower end of the other of the leg portions. The connecting portion of the connector in Patent Reference is soldered to a corresponding circuit portion of the circuit board.

The two leg portions of the holding arm extending in the lower direction sandwiching the sidewall. The two leg portions include protrusions protruding toward an inner surface and an outer surface of the sidewall, respectively. The sidewall is inserted between the two leg portions of the holding arm, so that the terminal is attached to the housing from the upper direction. The holding arm sandwiches the sidewall as well as the protrusion bites into the surface of the sidewall.

To downsize the connector for the circuit board is highly demanded. Thus, for example, a thickness of the sidewall of the housing is reduced. In the connector disclosed in Patent Reference described above, the sidewall is sandwiched with the holding arm. The sidewall holds the holding arm by being pressed both of the outer surface and the inner surface thereof with the protrusions provided on the holding arm. Therefore, in order to obtain enough strength for the sidewall, it is necessary to make the sidewall thick.

The holding arm is necessary to be strong enough against a reaction force from the sidewall generated by pressing the sidewall with the protrusion, adding to forming the protrusion thereon. Accordingly, it is necessary to be the holding arm wider. Consequently, since the sidewall of the housing becomes thicker and the holding arm of the terminal becomes wider, the connector grows in size.

Further, when the connecting portion of the terminal is soldered to the corresponding circuit portion of the circuit board, an external force is transmitted to the leg portion of the holding arm extending along the outer surface of the sidewall as the connector receives the external force inadvertently by twisting the mating connector and so on. As a result, the external force is transmitted to a soldered portion, where the connecting portion and the corresponding circuit portion are soldered. Consequently, an electric connection may be poor at the soldered portion.

Furthermore, when the terminal is attached to the housing, the surface of the sidewall can be scraped with the protrusion of the leg portion as the sidewall is inserted between the leg portions of the holding arm of the terminal. As a result, scraped wastes can be generated by scraping and the scraped wastes can remain on the sidewall. Therefore, upon using the connector, an electrical conduction becomes poor at the corresponding circuit portion since the scraped wastes can fall and adhere on the corresponding circuit portion on the circuit board.

In view of the problems described above, an object of the present invention is to provide an electrical connector for a circuit board capable of reducing a size thereof as well as maintaining electrical conduction well at a soldered portion and a good connecting state at a corresponding circuit portion.

Further objects and advantages of the invention will be apparent from the following description of the invention.

SUMMARY OF THE INVENTION

In order to attain the objects described above, according to the present invention, an electrical connector (a connector) to be connected to a mating connector includes a housing to be disposed on a circuit board, a receiving recess portion formed in the housing for receiving the mating connector, and a terminal arranged in the housing. The receiving recess portion includes two sidewalls facing each other and extending in a direction the connector connects to the mating connector. The terminal includes a U-shape portion, an extending portion extending outside the receiving recess portion along one of two sidewalls facing outside (a first sidewall), and a connecting portion to be connected to the circuit board. The U-shape portion opens in an upper direction and includes a first arm portion and a second arm portion fitted in the receiving recess portion and combined to each other. The first arm portion is fitted along the first sidewall and the second arm portion is fitted along a second sidewall, that is, other of the two sidewalls facing the first sidewall.

In the electrical connector in the present invention, the first arm portion and the second arm portion of the U-shape portion include locking portions for being fixed against an inner surface of the receiving recess portion, respectively. The first and second arm portions of the U-shape portion are capable of elastic deformation at a portion other than the locking portion thereof. The extending portion is arranged to be away from the first sidewall to form a space in between.

In the electrical connector in the present invention, the terminal is fixed to the inner surface of the receiving recess portion with the locking portion formed on the arm portion of the U-shape portion, and the space is formed between the extending portion of the terminal and an outer surface of the first sidewall. Therefore, the first sidewall is not held with the terminal by being sandwiched. Accordingly, either of an inner surface and the outer surface of the first sidewall does not receive a pressure from the terminal. Therefore, the pressure the first sidewall receives can be reduced. As a result, it is not necessary to maintain the first sidewall strong. Consequently, a thickness of the first sidewall can be reduced.

In addition, in the electrical connector in the present invention, the space is formed between the extending portion of the terminal and the outer surface of the first sidewall. Therefore, compared to a case of the conventional connector, the first sidewall is not held by being sandwiched with the terminal. Therefore, it is not necessary to provide a protrusion for pressing the first sidewall in the extending portion and to make the extending portion wider in order to obtain strength against a reaction force from the first sidewall. Consequently, it is possible to downsize the connector since it is not necessary to form the first sidewall thicker and to form the terminal wider.

Further, since the space is formed between the extending portion of the terminal and the outer surface of the first sidewall, when the first sidewall is deformed toward the extending portion as the connector receives the external force inadvertently, the first sidewall hardly abuts against the extending portion because of the space therebetween. Therefore, the external force is hardly transmitted to the extending portion. As a result, the external force is applied to where the connecting portion and a corresponding circuit portion are connected.

Further, a distance between the first arm portion of the U-shape portion of the terminal and the extending portion is as little as the space can be formed between the extending portion of the terminal and the outer surface of the first sidewall, when the terminal is attached to the housing. The distance described above is larger than the thickness of the first sidewall. Accordingly, the first sidewall enters between the first arm portion and the extending portion without generating a contact pressure when the terminal is attached to the housing. Consequently, scraped wastes are not generated by scraping the first sidewall of the housing. Furthermore, the scraped wastes do not remain on the outer surface of the first sidewall. As a result, upon using the connector, it is possible to maintain an electrical conduction well since the scraped wastes do not fall and adhere on the corresponding circuit portion of the circuit board.

The second arm portion of the U-shape portion includes a contacting portion at a distal end portion of the second arm portion for contacting with a mating terminal of the mating connector. The distal end portion of the second arm portion is situated at an opening side of the receiving recess portion. It is preferable that the locking portions of the arm portions are situated close to a bottom portion of the receiving recess portion and are fixed against side surfaces of the receiving recess portion respectively, so as to face each other.

When the terminal is attached to the housing and the connector is connected to the mating connector, the locking portion of the first arm portion of the U-shape portion of the terminal presses against the inner surface of the first sidewall of the receiving recess portion. The inner surface of the receiving recess portion extends along the first arm portion and forms a portion of an inner surface of the receiving recess portion. Accordingly, the first sidewall receives a force via the locking portion. Thereby, a bending moment is applied to the first sidewall. Strength of the bending moment depends on a distance between where the locking portion presses against the inner surface of the first sidewall and where the bottom portion of the receiving recess portion, in other words, a base portion of the first sidewall, is situated. When the locking portion is situated closer to the bottom portion of the receiving recess portion of the housing, the distance becomes shorter. As a result, the bending moment applied to the first sidewall becomes smaller. Thereby, it is possible to reduce burden to the housing.

Further, the second arm portion of the U-shape portion includes the contacting portion at a distal end portion thereof and the locking portion close to the bottom portion of the receiving recess portion. Therefore, there is a sufficient distance between the contacting portion and the locking portion. Accordingly, the second arm portion has a portion capable of elastic deformation with a plenty of length. Consequently, the second arm portion deforms elastically by a large amount when the connector is connected to the mating connector. As a result, it is possible to contact the contacting portion with the mating terminal of the mating connector with a sufficiently strong contact pressure.

It is preferable that at least one of the locking portions of the U-shape portion is formed as a protrusion for biting into the side surface of the receiving recess portion. It is possible to prevent the terminal from coming off from the housing, since the locking portion bites into the receiving recess portion.

The first sidewall extending along the first arm portion of the terminal fixes the locking portion of the first arm portion. The first sidewall may be arranged to deform toward outside by being pressed with the first arm portion of the U-shape portion when the electrical connector is connected to the mating connector.

As described above, in the present invention, the terminal is fixed to the inner surfaces of the receiving recess portion with the locking portion. Further, the locking portion is formed on each of the first arm portion and the second arm portion of the U-shape portion. Furthermore, the extending portion of the terminal is arranged to be away from the first sidewall to form a space in between. Therefore, the first sidewall does not receive a pressure by the terminal with both of the inner and outer surfaces thereof. Accordingly, the thickness of the first sidewall can be reduced since it is not necessary to maintain the first sidewall too strong.

In addition, it is not necessary to provide a protrusion for pressing the first sidewall in the extending portion or to make the extending portion wider in order to obtain strength against a reaction force from the first sidewall. Consequently, in the present invention, it is possible to downsize the connector by forming the first sidewall thinner and forming the extending portion narrower.

In addition, the space is formed between the extending portion of the terminal and the outer surface of first sidewall. Therefore, when the first sidewall is deformed toward the extending portion as the connector receives the external force inadvertently, the first sidewall hardly abuts against the extending portion. Accordingly, the force is hardly transmitted to where the connecting portion and the corresponding circuit portion are connected. As a result, it is possible to maintain a good connecting state at the connected portion described above.

Furthermore, a distance between the first arm portion of the U-shape portion of the terminal and the extending portion is as little as the space formed between the extending portion of the terminal and the outer surface of the first sidewall, when the terminal is attached to the housing. Accordingly, the first sidewall enters between the one of the arm portion and the extending portion without generating a contact pressure when the terminal is attached to the housing. Therefore, the extending portion does not scrape the surface of the first sidewall. Consequently, scraped wastes are not generated. Furthermore, the scraped wastes do not remain on the outer surface of the first sidewall. As a result, upon using the connector, it is possible to maintain an electrical conduction well since the scraped wastes do not fall and adhere on the corresponding circuit portion on the circuit board.

BRIEF DESCRIPTION OF THE DRAWINGS

FIGS. 2(A) and 2(B) are sectional views taken along a line II-II in FIG. 1, showing a process of assembling the electrical connector according to the first embodiment of the present invention, wherein FIG. 2(A) shows a state that a terminal is in a halfway of being attached to a housing, and FIG. 2(B) shows a state the terminal is completely attached to the housing;

FIGS. 4(A) and 4(B) are sectional views showing a process of connecting the mating connector to the electrical connector according to the first embodiment of the present invention, wherein FIG. 4(A) shows a state before the mating connector is connected to the electrical connector, FIG. 4(B) shows a state after the mating connector is connected to the electrical connector;

DETAILED DESCRIPTION OF THE PREFERRED EMBODIMENTS

Hereunder, embodiments of the present invention will be explained with reference to the accompanying drawings.

First Embodiment

Figure 1:
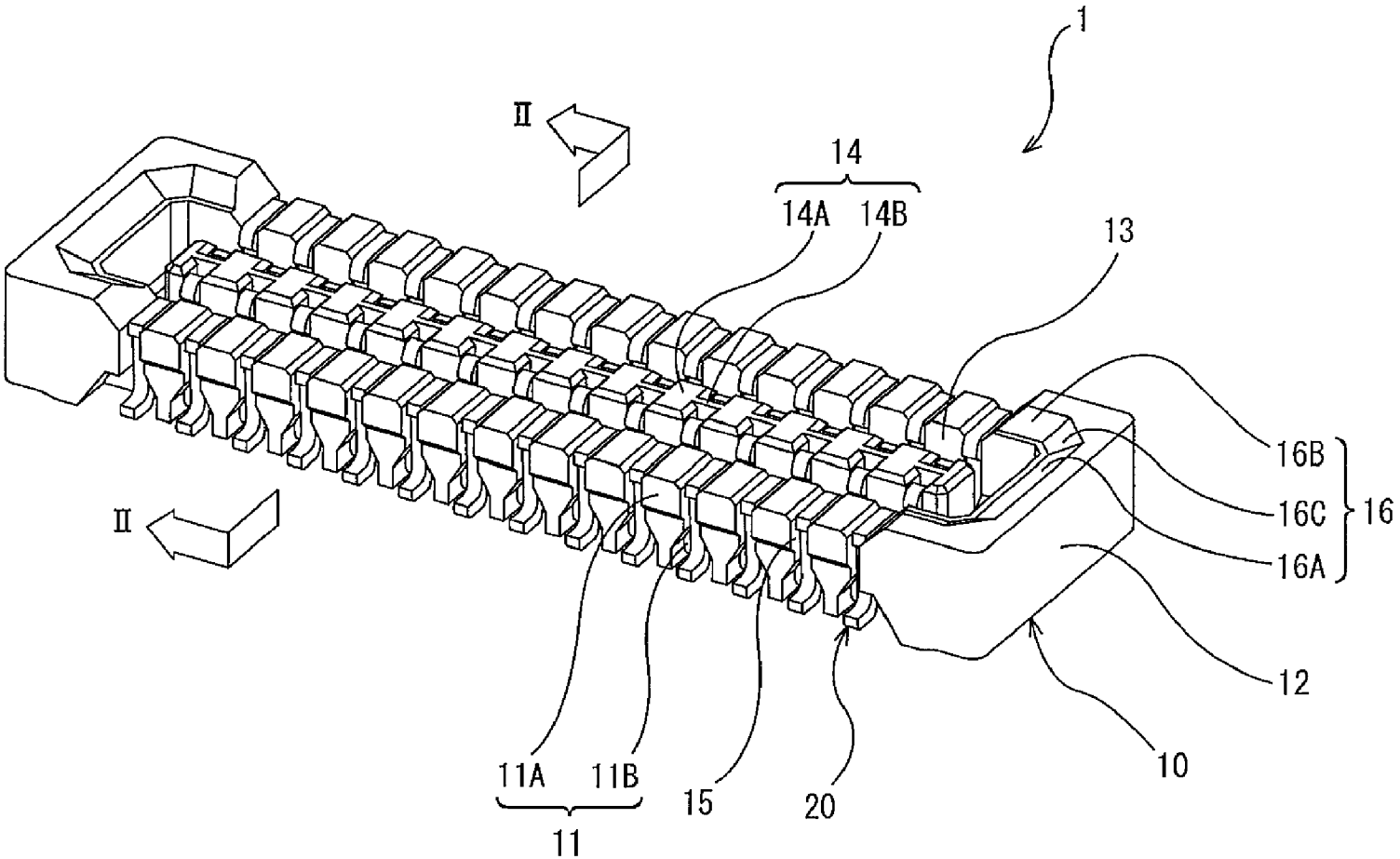
FIG. 1 is a perspective view showing an electrical connector according to a first embodiment of the present invention.
Figure 2A:
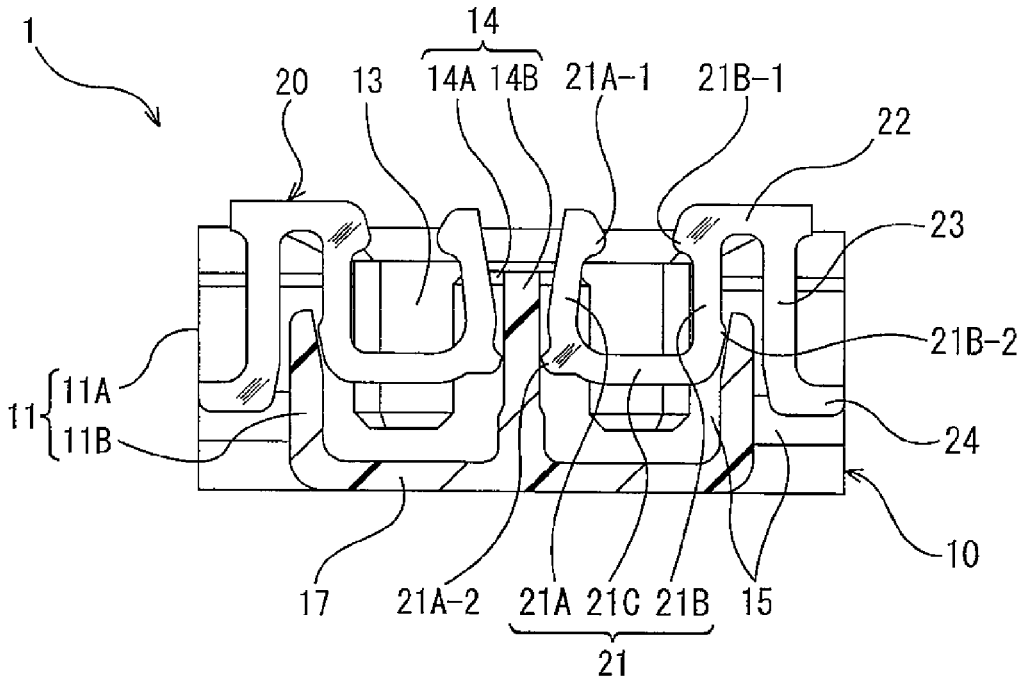
Figure 2B:
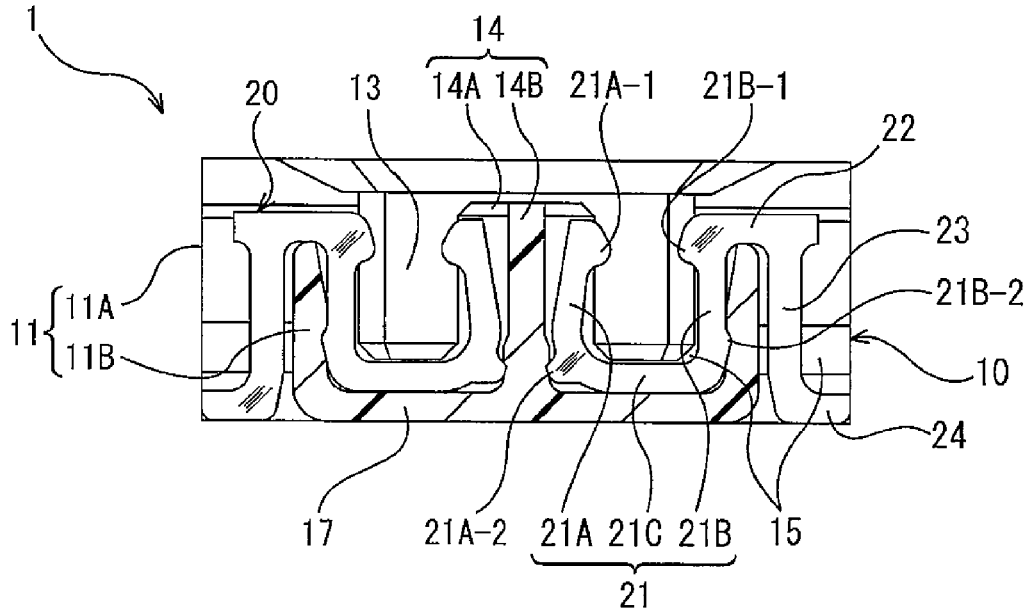

FIG. 1 is a perspective view showing an electrical connector 1 (a connector 1) for a circuit board according to an embodiment of the present invention. FIGS. 2(A) and 2(B) show an assembling process of the connector 1, wherein FIG. 2(A) shows a state that a terminal 20 is in a halfway of being attached to a housing 10, and FIG. 2(B) shows a state the terminal 20 is completely attached to the housing 10. FIGS. 2(A) and 2(B) are sectional views taken along a line II-II in FIG. 1, that is, where the terminal 20 is situated in a longitudinal direction of the housing 10.

As shown in FIG. 1, the connector 1 according to the embodiment of the present invention is to be attached to the circuit board (not shown). The connector 1 includes the housing 10 made of a synthetic resin and a plurality of the terminals 20 made of a metal plate disposed and held in the housing 10.

The housing 10 includes a receiving recess portion 13 opening in an upper direction. The connector 1 receives a mating connector 2, described later, with the receiving recess portion 13 from the upper direction. The receiving recess portion 13 is surrounded by a circumference wall portion. The circumference wall portion is composed of two side wall portions 11 extending in the longitudinal direction of the housing 10 and two end wall portions 12 extending in a perpendicular direction of the longitudinal direction or a lateral direction. The end wall portion 12 connects end portions of the side wall portions 11 to each other. Further, a central wall portion 14 is provided at a central portion of the receiving recess portion 13. The central wall portion 14 protrudes from a bottom wall portion 17 in the upper direction and extends in the longitudinal direction. Therefore, the receiving recess portion 13 surrounds circularly the central wall portion 14 as being viewed from the upper direction.

As shown in FIGS. 2(A) and 2(B), the receiving recess portion 13 has a symmetrical shape about the central wall portion 14 upon being viewed in the longitudinal direction (a direction perpendicular to a sheet surface in FIGS. 2(A) and 2(B)). Inner surfaces of both right and left portions of the receiving recess portion 13 have U-letter shape as being viewed in the longitudinal direction, respectively. Accordingly, the inner surface includes a bottom surface and a side surface situated on both ends of the bottom surface. In the embodiment, the side surface forming a wall surface of the central wall portion 14 is referred to a "medial side surface" while the side surface forming a wall surface of the side wall portion 11 is referred to a "peripheral side surface".

The housing 10, as shown in FIG. 1, includes a terminal holding groove 15 for holding the terminal 20. A plurality of the terminal holding grooves is provided, being arranged with a specific interval next to each other in the longitudinal direction of the housing 10. As shown in FIGS. 2(A) and 2(B), the terminal holding groove 15 is formed extending from the inner surface of the receiving recess portion 13 having the U-letter shape (the medial side surface, the bottom surface and the peripheral side surface) to outside of the receiving recess portion 13, that is, to an upper surface and an outer surface of the side wall portion 11. The terminal holding groove 15 has a symmetrical shape about the central wall portion as being viewed in the longitudinal direction.

The side wall portion 11 includes a main side wall portion 11A situated between the terminal holding grooves 15 next to each other in the longitudinal direction and a secondary side wall portion 11B situated where the terminal holding groove 15 is provided in the longitudinal direction. A portion of the terminal holding groove 15 is composed of an outer surface, an upper surface and an inner surface of the secondary side wall portion 11B. In addition, the central wall portion 14 includes a main central wall portion 14A situated between the terminal holding grooves 15 next to each other in the longitudinal direction and a secondary central wall portion 14B situated where the terminal holding groove 15 is provided in the longitudinal direction.

As shown in FIG. 1, the housing 10 further includes a sloped surface at both end portions in the longitudinal direction thereof. The sloped surface extends along an edge portion of an opening of the receiving recess portion 13 and is sloped toward outside of the housing 10 as ascending in the upper direction. The sloped surface forms a guiding surface 16 for guiding the mating connector 2 into the receiving recess portion 13 when the mating connector 2 is connected to the connector 1. The guiding surface 16 includes a guiding surface 16A situated in the end wall portion 12 and formed to be sloped in the longitudinal direction, a guiding surface 16B situated in the side wall portion 11 and formed to be sloped in the lateral direction and a guiding surface 16C connecting the guiding surface 16A and the guiding surface 16B.

The terminal 20, as shown in FIG. 1, is held in the housing 10 being disposed in two lines in the longitudinal direction of the housing 10. In the embodiment, the terminal 20 is formed by punching a metal plate into S-letter shape. As shown in FIG. 2(B), the terminal 20 is held symmetrically about the central wall portion 14 having a position of a lateral S-letter shape, as being viewed in the longitudinal direction (the direction perpendicular to a sheet surface).

The terminal 20 is situated along the inner surface of the receiving recess portion 13. The terminal 20 includes a U-shape portion 21 opening in an opening direction of the receiving recess portion 13, that is, the upper direction. The terminal 20 further includes an extending portion 23 situated along the outer surface of the secondary side wall portion 11B, a transition portion 22 transitioning from an engaging arm portion 21B, described later, to the extending portion 23, and a connecting portion 24 for being soldered to a corresponding circuit portion (not shown) of the circuit board. The connecting portion 24 extends from a lower end of the extending portion 23. The engaging arm portion 21B is one of two arm portions of the U-shape portion 21. The engaging arm portion 21B is situated along the inner surface of the secondary side wall portion 11B.

The transition portion 22 extends in a direction outside of the receiving recess portion 13 on an upper side of the secondary side wall portion 11B. That is, the transition portion 22 extends in a direction away from the secondary central wall portion 14B horizontally in FIG. 2(B). The extending portion 23 extends from the transition portion 22 to the circuit board (not shown) along the outer surface of the secondary side wall portion 11B, in other words, extends in a lower direction. Further, the connecting portion 24 extends from a lower end portion of the extending portion 23 in a direction away from the secondary side wall portion 11B (outside of the connector 1) and is situated on the corresponding circuit portion.

Nearly the whole of the U-shape portion 21 is settled in the terminal holding groove 15. The U-shape portion 21 includes a contact arm portion 21A extending in a vertical direction along the secondary central wall portion 14B. The contact arm portion 21A is capable of deformation. The U-shape portion 21 further includes the engaging arm portion 21B extending in the vertical direction along the secondary side wall portion 11B and a combining portion 21C extending along the bottom wall portion 17 of the housing 10 and combining lower end portions of the contact arm portion 21A and the engaging arm portion 21B.

The contact arm portion 21A extends in the upper direction so as to be away from the secondary central wall portion 14B, that is, extends slightly leaning toward the receiving recess portion 13. An upper end of the contact arm portion 21A is a distal end and situated at a side of the opening of the receiving recess portion 13. The contact arm portion 21A includes a contacting protrusion 21A-1 in the upper end thereof. The contacting protrusion 21A-1 protrudes inside the receiving recess portion 13. The contact arm portion 21A further includes a locking portion 21A-2 at a position next to the combining portion 21C. The locking portion 21A-2 is a protrusion protruding toward the secondary central wall portion 14B in the horizontal direction in FIG. 2(B).

The engaging arm portion 21B includes an engaging protrusion 21B-1 protruding inside the receiving recess portion 13 at an upper end portion thereof. The engaging protrusion 21B-1 engages an engaged portion of a mating terminal of the mating connector 2, described later. The engaging arm portion 21B further includes a locking portion 21B-2 protruding toward the secondary side wall portion 11B in the horizontal direction in FIG. 2(B). The locking portion 21B-2 is provided at a position close to the bottom wall portion 17 in the vertical direction in FIG. 2(B).

The extending portion 23 extends approximately parallel to the engaging arm portion 21B of the U-shape portion 21, in other words, the extending portion 23 extends in the vertical direction. A distance between the extending portion 23 and the engaging arm portion 21B is larger than a thickness of the secondary side wall portion 11B. Therefore, there is a space between the extending portion 23 and the secondary side wall portion 11B. A lower edge portion of the connecting portion 24 is situated in approximately the same level with an upper surface of the circuit board in the vertical direction. The lower edge portion of the connecting portion 24 is soldered to the corresponding circuit portion of the circuit board.

The connector 1 is assembled by disposing the plurality of the terminals 20 into the terminal holding grooves 15 of the housing 10. The terminal 20 is disposed from the upper direction. More specifically, the U-shape portion 21 is fixed as the locking portions 21A-2 and 21B-2 thereof are pressed into the receiving recess portion 13 of the housing 10 from the upper direction. Further, the engaging arm portion 21B, the combining portion 22 and the extending portion 23 are attached from the upper direction being placed over the secondary side wall portion 11B of the housing 10. In other wards, the secondary side wall portion 11B enters between the engaging arm portion 21B and the extending portion 23 from the lower direction.

As shown in FIG. 2(B), when the terminal 20 is held in the terminal holding groove 15 of the housing 10, the locking portion 21A-2 of the contact arm portion 21A of the U-shape portion 21 and the locking portion 21B-2 of the engaging arm portion 21B of the terminal 20 are fixed against the inner surface of the receiving recess portion 13. More specifically, the locking portion 21B-2 of the engaging arm portion 21B bites into the peripheral side surface of the receiving recess portion 13 or a wall surface of the secondary side wall portion 11B, further, at a position close to the bottom surface of the receiving recess portion 13, the locking portion 21A-2 of the contact arm portion 21A bites into the medial side surface of the receiving recess portion 13 or a wall surface of the secondary central wall portion 14B. As shown in FIG. 2(B), the contact arm portion 21A does not contact with the secondary central wall portion 14B except a region close to a lower end thereof in the vertical direction, that is, except where the locking portion 21A-2 is provided. Therefore, the contact arm portion 21A is capable of an elastic deformation in the horizontal direction in FIG. 2(B).

In the embodiment, the locking portions 21A-2 and 21B-2 are formed as protrusions for biting into the inner surfaces of the terminal holding groove 15 or the side surfaces of the receiving recess portion 13. Accordingly, the terminal 20 held in the housing 10 hardly comes off from the housing 10.

In addition, as described above, the distance between the extending portion 23 and the engaging arm portion 21B is larger than the thickness of the secondary side wall portion 11B. Therefore, as shown in FIG. 2(B), there is the space formed between the extending portion 23 and the outer surface of the secondary side wall portion 11B. As a result, in the embodiment, when the terminal 20 is held in the housing 10, the secondary side wall portion 11B enters between the extending portion 12 and the engaging arm portion 21B without generating a contact pressure against the extending portion 23. Consequently, the extending portion 23 does not scrape the outer surface of the secondary side wall portion 11B. Therefore, the outer surface of the secondary side wall portion 11B does not produce scraped wastes left thereon. As a result, it is possible to maintain an electrical conduction well at the corresponding circuit portion of the circuit board upon using the connector 1, since the scraped waste does not fall and attach on the corresponding circuit portion.

Further, in the embodiment, the housing 10 includes the bottom wall portion 17. Accordingly, the U-shape portion 21 of the terminal 20 situated in the receiving recess portion 13 is separated from the circuit board with the bottom wall portion 17. Consequently, it is possible to provide a circuit portion at a position beneath the U-shape portion 21 on the circuit board without concerning about a short circuit between the combining portion 21C of the terminal 20 and the circuit board. As a result, the circuit board can be used an area thereof more efficiently and the circuit portion can be designed more flexible. The bottom wall portion 17 is not essential. When the circuit portion is not provided beneath the U-shape portion 21, the housing 10 may include a receiving hall portion having a through-hole shape penetrating in the vertical direction instead of the receiving recess portion 13, without including the bottom wall portion 17.

Figure 3:
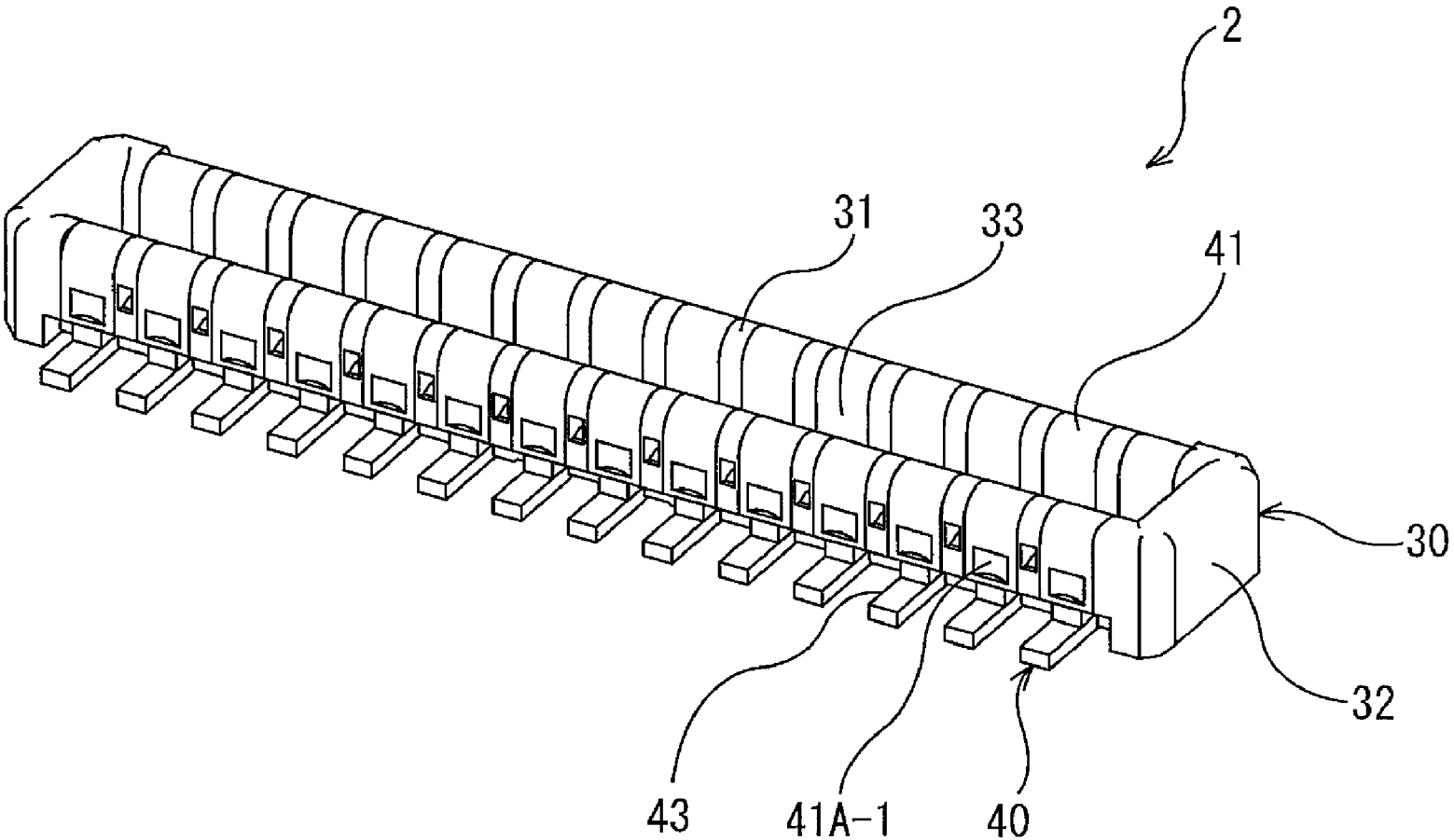
FIG. 3 is a perspective view showing a mating connector according to the first embodiment of the present invention.
Figure 4A:
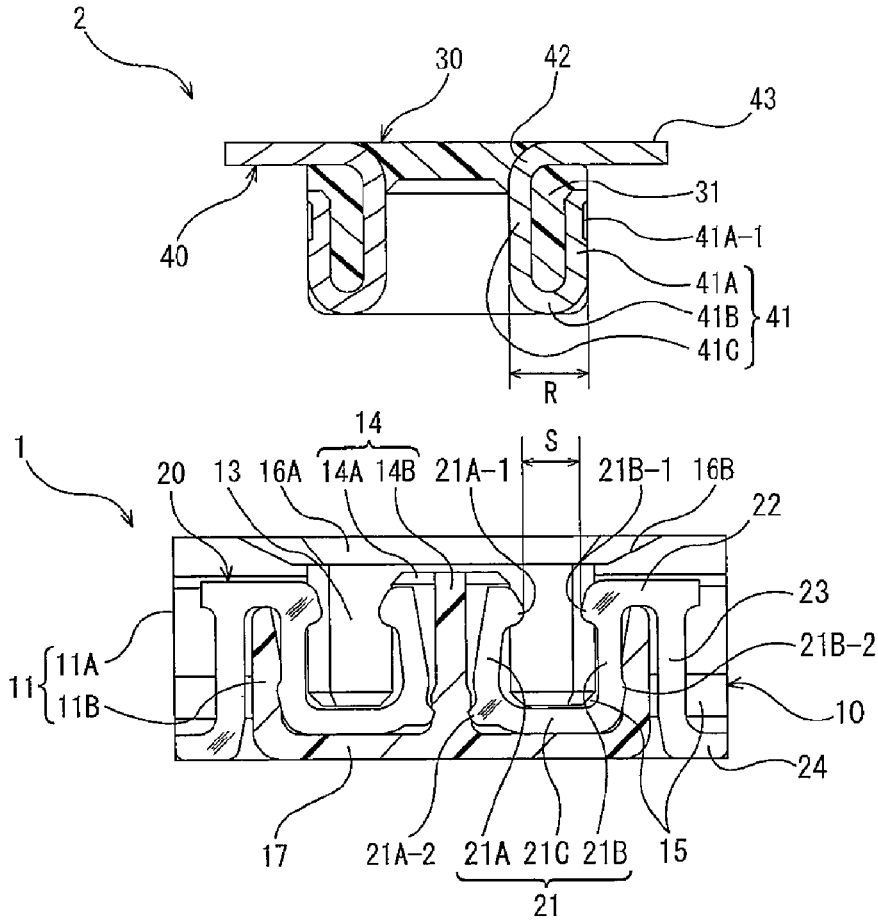
Figure 4B:
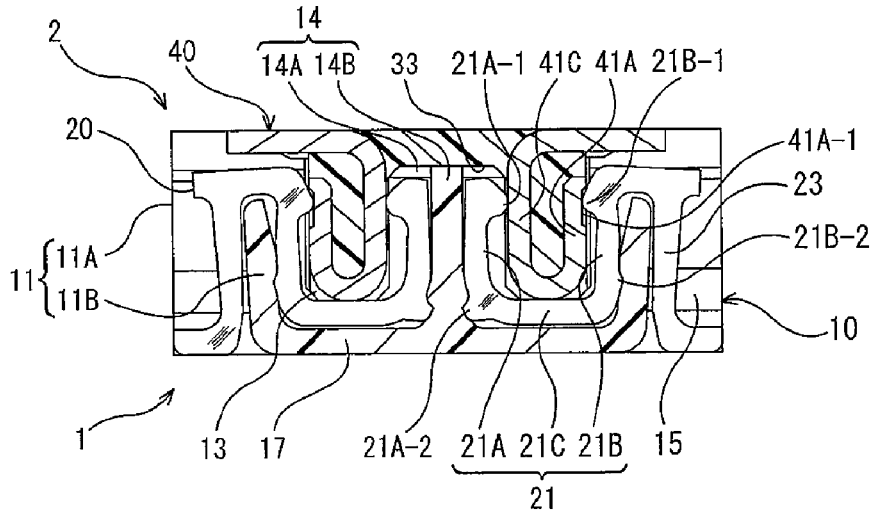

FIG. 3 is a perspective view of the mating connector 2 to be connected the connector 1. FIGS. 4(A) and 4(B) are sectional views taken along where the terminal is situated, showing a process of connecting the mating connector 2 to the connector 1. FIG. 4(A) shows a state before the mating connector 2 is connected to the connector 1, FIG. 4(B) shows a state after the mating connector 2 is connected to the connector 1. As compared FIG. 3 to FIG. 4(A), it is apparent that the mating connector 2 in FIG. 3 is shown with an upside down position thereof in FIGS. 4(A) and 4(B). Therefore, in FIG. 3, the upper direction is a forefront direction of a connecting direction of the connector 1 and the mating connector 2 (the connectors).

Similar to the connector 1, the mating connector 2 is to be attached to the circuit board (not shown). As shown in FIG. 3, the mating connector 2 includes a housing 30 made of a synthetic resin having a substantially rectangular parallelepiped shape and a plurality of the terminals 40 made of a metal disposed and held in the housing 30. Hereunder, the terminal 40 will be called "mating terminal 40" in order to distinguish from the terminal 20 of the connector 1.

The housing 30 includes a receiving recess portion 33 opening in the upper direction in FIG. 3 (the lower direction in FIGS. 4(A) and 4(B)). The receiving recess portion 33 receives the central wall portion 14 of the connector 1. The receiving recess portion 33 is surrounded by a circumference wall portion. The circumference wall portion is composed of two side wall portions 31 extending in a longitudinal direction of the housing 30 and two end wall portions 32 extending in a direction perpendicular to the longitudinal direction, that is, a lateral direction. The end wall portion 32 connects end portions of the side wall portions 31 to each other. The circumference wall portion of the housing 30 has a shape suitable to the receiving recess portion 13 of the connector 1. When the connectors are connected to each other, the circumference wall portion is inserted into the receiving recess portion 13 as the longitudinal directions of the connector 1 and the mating connector 2 are conformed to each other.

The mating terminal 40 is formed by bending a strip-shaped metal plate in a thickness direction thereof. The mating terminal 40 is formed integrally with the housing 30 and the mating terminal 40 is disposed in both of the side wall portions 31 with an interval in the longitudinal direction of the housing 30, as well as being disposed symmetrically in the horizontal direction in FIGS. 4(A) and 4(B). As shown in FIGS. 4(A) and 4(B), the mating terminal 40 includes an insertion portion 41, a bent portion 42 and a connecting portion 43. The insertion portion 41 extends along an outer surface, a lower surface and an inner surface of the side wall portion 31 with a U-letter shape. The bent portion 42 extends from an upper portion of a corresponding contact arm portion 41C and is bent in a direction away from the receiving recess portion 31 (outside of the connectors) in the horizontal direction in FIGS. 4(A) and 4(B). The corresponding contact arm portion 41C is one of two arm portions of the insertion portion 41, situated at a closer side to the receiving recess portion 33. The connecting portion 43 is continued from the bent portion 42 and protrudes from the side wall portion 31 toward outside of the connectors.

As shown in FIGS. 4(A) and 4(B), the insertion portion 41 and the bent portion 42 of the mating terminal 40 are held in the housing 30 by molding integrally with the housing 30. Further, a surface of the insertion portion 41, which is not situated in a side of the side wall portion 31 and an all surfaces of the connecting portion 43 are exposed from the housing 30.

The insertion portion 41 includes an engaged arm portion 41A, a transition portion 41B and the corresponding contact arm portion 41C. The engaged arm portion 41A is situated side of the outer surface of the side wall portion 31 in FIG. 4(A) and extends in the vertical direction. The transition portion 41B continues from a lower end portion of the engaged arm portion 41A and extends being curved toward the receiving recess portion 33. The corresponding contact arm portion 41C continues from the transition portion 41B and extends in the upper direction from a position close to the receiving recess portion 33. The engaged arm portion 41A includes an engaged recess portion 41A-1 on a position close to an upper end (a position close to a lower end in FIG. 3) of an exposed surface thereof. The engaged recess portion 41A-1 is provided by press working. As described later, the engaged recess portion 41A-1 is engaged the engaging protrusion 21B-1 of the terminal 20 of the connector 1 in the connecting direction of the connectors (the vertical direction in FIGS. 4(A) and 4(B)) when the connectors are connected to each other. The corresponding contact arm portion 41C has a flat surface through the entire surface exposed toward the receiving recess portion 33. When the connectors are connected to each other, the flat surface of the corresponding contact arm portion 41C contacts with the contacting protrusion 21A-1 of the connector 1. It is not required that the corresponding contact arm portion 41C has the flat surface through the entire surface thereof. For example, the corresponding contact arm portion 41C may include a recessed portion at a position contacting with the contacting protrusion 21A-1.

As shown in FIG. 4(A), a distance R between the exposed surface of the engaged arm portion 41A and the exposed surface of the corresponding contact arm portion 41C in the horizontal direction is larger than a distance S between the contacting protrusion 21A-1 and the engaging protrusion 21B-1 of the terminal 20 of the connector 1 in the same direction.

An upper surface of the connecting portion 43 (a lower surface thereof in FIG. 3) is situated in approximately the same level with an upper surface of the housing 30 (a lower surface thereof in FIG. 3). The upper surface of the connecting portion 43 is soldered to a corresponding circuit portion (not shown) of a circuit board.

Hereunder, with reference to FIGS. 4(A) and 4(B), the process of connecting the mating connector 2 to the connector 1 will be explained.

First, the connector 1 and the mating connector 2 are soldered to the corresponding circuit portions on the circuit boards (not shown), respectively. Next, as shown in FIG. 4(A), the mating connector 2 is placed over the connector 1, in a right position, that is, a position that the circumference wall portion and the receiving recess portion 33 of the mating connector 2 face the receiving recess portion 13 and the central wall portion 14 of the connector 1 in the vertical direction, respectively.

Next, the mating connector 2 is moved in the lower direction and is connected to the connector 1. More specifically, the circumference wall portion of the mating connector 2 is inserted into the receiving recess portion 13 of the connector 1 from the upper direction, as well as the central wall portion 14 of the connector 1 is inserted into the receiving recess portion 33 of the mating connector 2 from the lower direction. Prior to connecting the mating connector 2 to the connector 1 as shown in FIG. 4(A), when the mating connector 2 is not placed at the right position exactly, a lower edge portion of the circumference wall portion of the mating connector 2 abuts against the guiding surface 16 of the housing 10 of the connector 1 and is guided in the longitudinal direction and the lateral direction of the housing 10. Thereby, the connector 2 is brought to a position capable to connect to the connector 1.

When the circumference wall portion of the mating connector 2 enters the receiving recess portion 13 of the connector 1, the insertion portion 41 of the mating terminal 40 of the mating connector 2 enters the receiving recess portion 13 pushing the contacting protrusion 21A-1 and the engaging protrusion 21B-1 of the terminal 20 of the connector 1 after abutting the contacting protrusion 21A-1 and the engaging protrusion 21B-1. More specifically, the corresponding contact arm portion 41C of the insertion portion 41 of the mating connector 1 pushes the contacting protrusion 21A-1 of the connector 1 so as to be deformed elastically toward the secondary central wall portion 14B in the terminal holding groove 15. Further, the engaged arm portion 41A of the insertion portion 41 pushes the engaging protrusion 21B-1 of the connector 1 so as to be slightly deformed elastically toward the secondary side wall portion 11B. Furthermore, the central wall portion 14 of the connector 1 enters the receiving recess portion 33 of the mating connector 2 as the circumference wall portion of the mating connector 2 enters the receiving recess portion 13 of the connector 1.

As the mating connector 2 enters further, an upper surface of the central wall portion 14 of the connector 1 abuts against a bottom surface, in other words, an inner upper surface of the receiving recess portion 33 of the mating connector 2. Thereby, as shown in FIG. 4(B), the process of connecting the mating connector 2 to the connector 1 is completed.

When the connectors are connected to each other, the contacting protrusion 21A-1 of the terminal 20 is pressed by the corresponding contact arm portion 41C of the mating terminal 40 and is deformed elastically into the terminal holding groove 15, thereby maintaining a state of contacting with the corresponding contact arm portion 41C with a predetermined contact pressure. In the embodiment, the contacting protrusion 21A-1 is situated in the upper end of the contact arm portion 21A and the locking portion 21A-2 is situated close to the lower end portion of the contact arm portion 21. Therefore, the contacting protrusion 21A-1 and the locking portion 21A-2 have a sufficient interval relative to each other. Accordingly, the contact arm portion 21A has an enough arm length for being deformed elastically. Therefore, the contacting protrusion 21A-1 is deformed elastically by a sufficient amount when the connectors are connected to each other. As a result, the contacting protrusion 21A-1 can contact with the corresponding contact arm portion 41C of the mating terminal 40 with the sufficient contact pressure.

When the connectors are connected to each other, as shown in FIG. 4(B), the engaging protrusion 21B-1 of the terminal 20 of the connector 1 engages the engaged recess portion 41A-1 in the connecting direction of the connectors (the vertical direction), thereby working as a locking function. Accordingly, it is possible to prevent the connectors from coming off by an inadvertent external force. The engaging protrusion 21B-1 may be used as a contacting portion for contacting electrically with the mating terminal.

The engaging protrusion 21B-1 contacts with the engaged recess portion 41A-1 with a contact pressure. A force toward the outside of the connectors, that is, a force the engaging protrusion 21B-1 receives from the engaged recess portion 41A-1 is transmitted to the secondary side wall portion 11B of the housing 10 via the locking portion 21B-2 of the engaging arm portion 21B of the terminal 20. Therefore, as shown in FIG. 4(B), upon receiving the force, the secondary side wall portion 11B is slightly deformed elastically toward the outside of the connectors, in other words, toward the extending portion 23.

As shown in FIG. 4(A), in the embodiment, before the connectors are connected to each other, the sufficient space is formed between the extending portion 23 of the terminal 20 and the outer surface of secondary side wall portion 11B. Therefore, when the connectors are connected to each other and the secondary side wall portion 11B is deformed elastically toward the extending portion 23, the secondary side wall portion 11B does not contact with the extending portion 23 though the space becomes narrower. Accordingly, the force is not transmitted to the extending portion 23, thus the force is not applied to where the connecting portion 24 and the corresponding circuit portion are soldered on the circuit board. As a result, when the connectors are connected to each other, it is possible to maintain a good connecting state at the soldered portion described above without being damaged.

In the embodiment, as described above, the space between the extending portion 23 of the terminal 20 and the outer surface of secondary side wall portion 11B is kept after the connectors are connected to each other. Consequently, when the secondary side wall portion 11B is further deformed toward the extending portion 23 as the connector 1 receives the external force inadvertently by twisting the mating connector 2 and so on, the external force is not transmitted to the extending portion 23 since the secondary side wall portion 11B does not abut against the extending portion 23.

When the secondary side wall portion 11B abuts against the extending portion 23 by chance, the external force thus transmitted is weak, since the secondary side wall portion 11B abuts very lightly against the extending portion 23. As a result, the force is not applied or applied very little to where the connecting portion 24 and the corresponding circuit portion are soldered on the circuit board. Therefore, when the connectors are connected to each other, it is possible to maintain a good connecting state at the soldered portion described above without being damaged.

In the embodiment, the engaging arm portion 21B includes the locking portion 21B-2 close to the lower end portion, that is, close to a bottom portion of the receiving recess portion 13. Accordingly, a distance between a position where the locking portion 21A-2 presses the secondary side wall portion 11B and the bottom portion of the receiving recess portion 13 in the vertical direction is short. The shorter the distance is, the smaller bending moment applied to the secondary side wall portion 11B becomes. Thereby, it is possible to make burden to the housing 10 lesser.

In the embodiment, the space is formed between the extending portion 23 of the terminal 20 and the secondary side wall portion 11B of the housing 10. Therefore, the secondary side wall portion 11B is not held by being sandwiched with the terminal 20. Accordingly, either of the inner surface and the outer surface of the secondary side wall portion 11B does not receive pressure from the terminal 20. Therefore, compared to a case of the conventional connector, that is, a case that both of the inner and outer surfaces of the side wall portion of the housing receive the pressure from terminal, the pressure the secondary side wall portion 11B receives can be reduced. As a result, it is not necessary to maintain strength of the secondary side wall portion 11B high, since the pressure mentioned above can be reduced. Consequently, the thickness of the secondary side wall portion 11B can be reduced.

In addition, in the embodiment, it is not necessary to provide a protrusion for pressing the secondary side wall portion 11B in the extending portion 23 and to make the extending portion 23 wider in order to obtain strength against a reaction force from the secondary side wall portion 11B. Consequently, in the embodiment, it is possible to downsize the connector 1 since it is not necessary to form the secondary side wall portion 11B thicker and to form the extending portion 23 wider.

In the embodiment, the central portion is provided in the central portion of the receiving recess portion. Further, the connector in the embodiment has a symmetrical shape about the central wall portion, as being viewed in the longitudinal direction thereof. Configurations to which the present invention is applicable are not limited to the case described above. For example, the present invention is applicable to a connector having a shape of one of two pieces obtained by dividing the connector in the embodiment at the center in the lateral direction. In other words, the present invention is applicable to a connector with terminals disposed and held in the housing in one line in the longitudinal direction thereof, without having the central wall portion in the receiving recess portion of the housing.

In the embodiment, as described above, when the connectors are connected to each other, the engaging protrusion 21B-1 contacts with the engaged recess portion 41A-1 with the contact pressure. It is not required to contact with the contact pressure as described above. As long as the engaging protrusion 21B-1 enters and engages the engaged recess portion 41A-1 in the connecting direction of the connectors when the connectors are connected to each other, the engaging protrusion 21B-1 may contact with the engaged recess portion 41A-1 without the contact pressure. The engaging protrusion 21B-1 may not even contact with the engaged recess portion 41A-1. In this case, as far as the mating connector 2 does not receive the external force inadvertently, the engaging protrusion 21A-1 does not receive the force toward outside of the connector from the engaged recess portion 41A-1 when the connectors are connected to each other. As a result, the secondary side wall portion 11B is hardly deformed elastically toward the extending portion 23.

Second Embodiment

In the connector according to a second embodiment, the locking portion of the engaging arm portion of the terminal does not have a protruding shape while the connector in the first embodiment has the locking portion with the protruding shape in the engaging arm portion. The connector according to the embodiment has the same configuration with the connector according to the first embodiment as a basic structure. Accordingly, the components in the embodiment will be given reference numerals adding 100 to the reference numerals of the same components in the first embodiment respectively, and the explanation thereof will be omitted. Differences from the first embodiment will be mainly explained.

Figure 5:
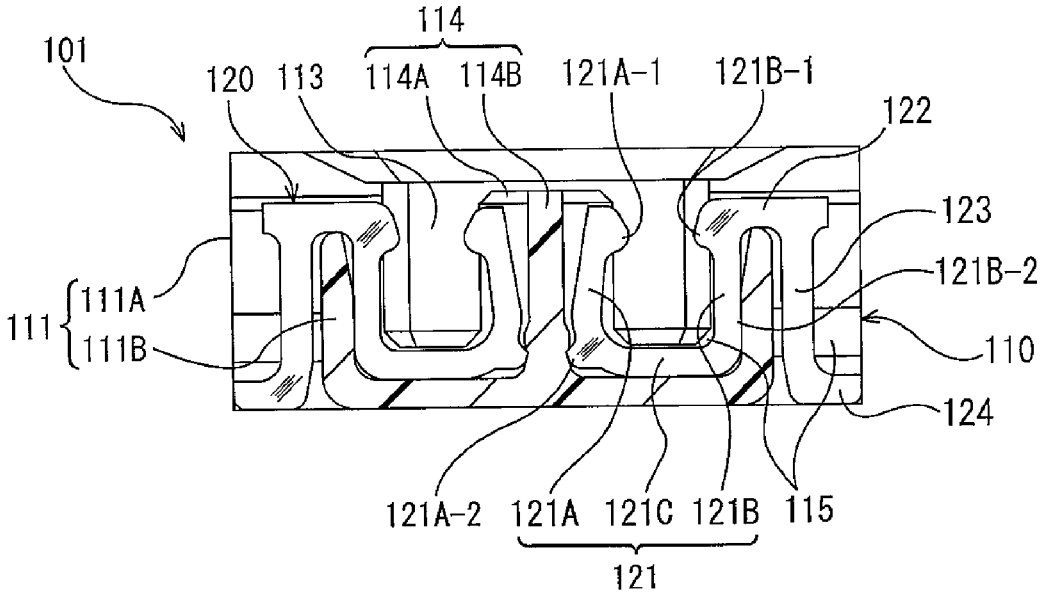
FIG. 5 is a sectional view showing an electrical connector according to a second embodiment of the present invention.

FIG. 5 is a sectional view showing a connector 101 according to the embodiment. As shown in FIG. 5, an engaging arm portion 121B includes an edge portion facing an inner surface of a secondary side wall portion 111B (an outside surface of a receiving recess portion 113) and extending in the vertical direction. The edge portion has a straight shape. In addition, a lower half portion of the edge portion is formed as a locking portion 121B-2 for contacting with the outside surface of the receiving recess portion 113 with a contact pressure. Therefore, in the connector 101, a locking portion 121A-2 of a contact arm portion 121A and the locking portion 121B-2 of the engaging arm portion 121B are held and fixed in a terminal holding groove 115.

Third Embodiment

In the connector according to a third embodiment, the locking portion of the engaging arm portion of the terminal does not have a protruding shape while the connector in the first embodiment has the locking portion with the protruding shape of the engaging arm portion. The connector according to the embodiment has the same configuration with the connector according to the first embodiment as a basic structure. Accordingly, the components in the embodiment will be given reference numerals adding 200 to the reference numerals of the same components in the first embodiment respectively, and the explanation thereof will be omitted. Differences from the first embodiment will be mainly explained.

Figure 6:
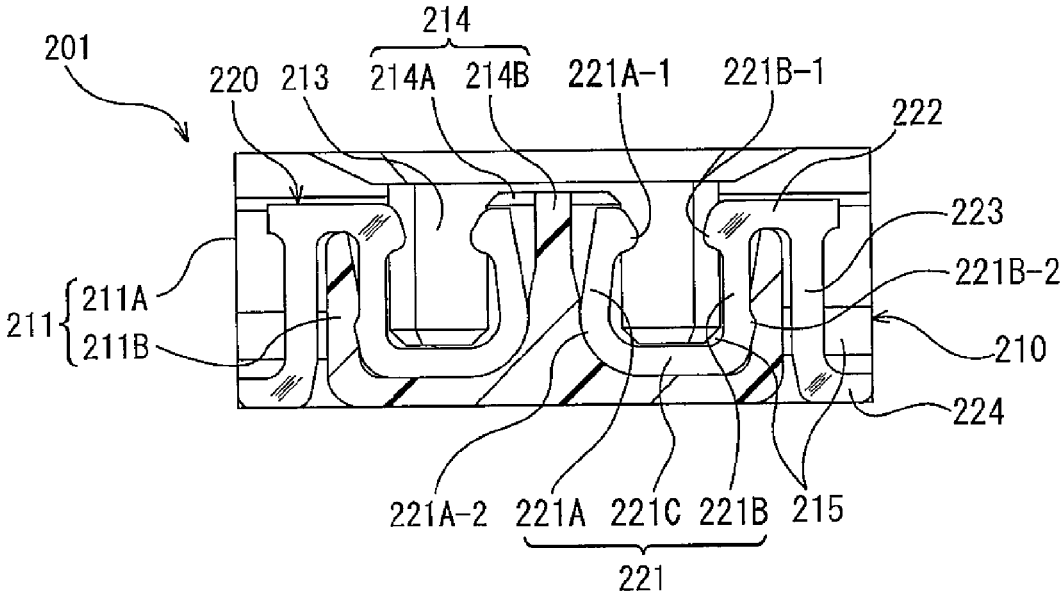
FIG. 6 is a sectional view showing an electrical connector according to a third embodiment of the present invention.

FIG. 6 is a sectional view showing a connector 201 according to the embodiment. As shown in FIG. 6, a contact arm portion 221A includes an edge portion facing a wall surface of a secondary central wall portion 214B (an inside surface of a receiving recess portion 213) and extending in the vertical direction. A lower half portion of the edge portion is smoothly curved in a convex shape. The lower half portion of the edge portion is formed as a locking portion 221A-2 for contacting with the inside surface of the receiving recess portion 213 with a contact pressure. Therefore, in the connector 201, the locking portion 221A-2 of the contact arm portion 221A and a locking portion 221B-2 of an engaging arm portion 221B are held and fixed in a terminal holding groove 215.

Fourth Embodiment

In the connector according to a fourth embodiment, the terminal is made by bending the metal plate having a strip-shape in a thickness direction thereof, while the terminal is formed by punching a metal plate so as to maintain a surface of the metal plate in the connector in the first embodiment. The connector according to the embodiment has the same configuration with the connector according to the first embodiment as a basic structure. Accordingly, the components in the embodiment will be given reference numerals adding 300 to the reference numerals of the same components in the first embodiment respectively, and the explanation thereof will be omitted. Differences from the first embodiment will be mainly explained.

Figure 7:
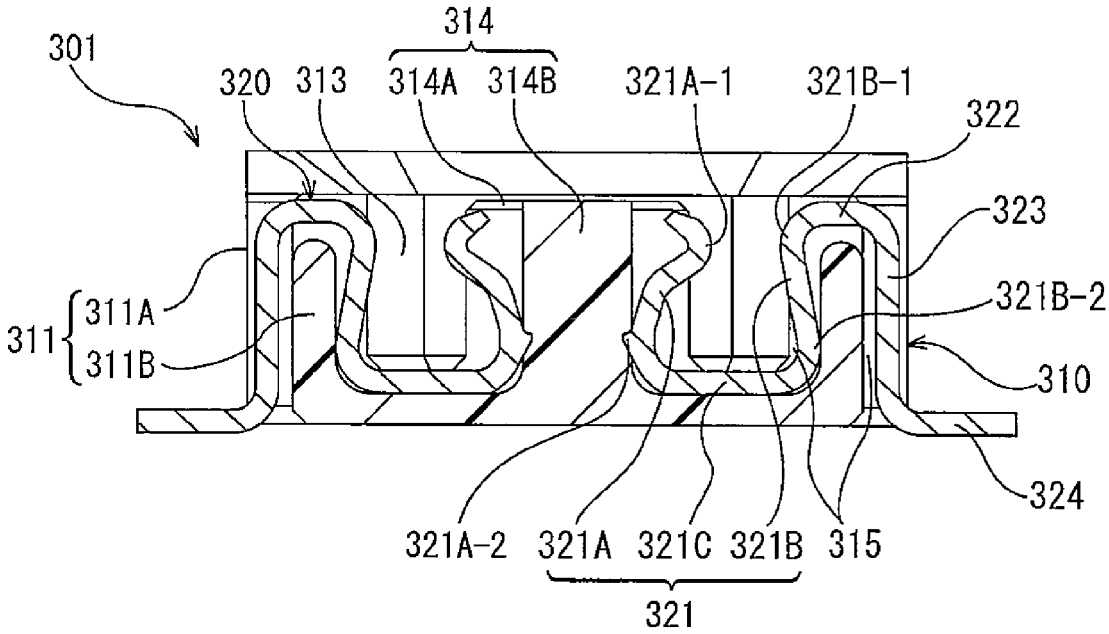
FIG. 7 is a sectional view showing an electrical connector according to a fourth embodiment of the present invention.

FIG. 7 is a sectional view showing a connector 301 according to the embodiment. In the embodiment, as shown in FIG. 7, a terminal 320 is formed by bending a strip-shaped metal plate in a thickness direction thereof. Similar to the terminal 20 in the first embodiment, the terminal 320 includes a U-shape portion 321, a transition portion 322 and a connecting portion 324.

A contact arm portion 321A of the U-shape portion 321 of the terminal 320 is curved so that an upper end portion which is a distal end portion thereof protrudes toward a receiving recess portion 313. A portion thus curved is formed as a contacting portion 321A-1. The contact arm portion 321A further includes a locking portion 321A-2 protruding toward a secondary central wall portion 314B. The locking portion 321A-2 is formed at a position close to a lower end of the contact arm portion 321A. That is, a position close to a bottom portion of the receiving recess portion 313. The locking portion 321A-2 is provided by embossing the plate surface of the contact arm portion 321A and bites into a wall surface of the secondary central wall portion 314B or into an inside surface of the receiving recess portion 313 as shown in FIG. 7.

A pressing arm portion 321B extending along a secondary side wall portion 311B of the U-shape portion 321 corresponds to the engaging arm portion 21B in the first embodiment. The pressing arm portion 321B is different from the engaging arm portion 21B in the first embodiment since the engaging protrusion and the locking portion do not have protruding shapes respectively. More specifically, the pressing arm portion 321B extends in the upper direction so as to be away from the secondary side wall portion 311B, that is, extends slightly leaning toward the receiving recess portion 313. Further, the pressing arm portion 321B includes a pressing portion 321B-1 at an upper end portion thereof. The pressing portion 321B-1 is curved in a convex shape and contacts with a mating terminal (not shown) with a contact pressure. In the embodiment, since the pressing portion 321B-1 contacts with the mating terminal of a mating connector (not shown) with a contact pressure, the mating connector can be prevented from coming off inadvertently.

In addition, a lower end portion of the pressing arm portion 321B is slightly curved in a convex shape toward an inner surface of the secondary side wall portion 311B, that is, an outside surface of the receiving recess portion 313. A portion thus curved is formed as a locking portion 321B-2 for contacting with the outside surface of the receiving recess portion 313 with a contact pressure. The terminal 320 is held in a terminal holding groove 315 with a locking portion 321A-2 of a contact arm portion 321A and the locking portion 321B-2 of the pressing arm portion 321B. Therefore, in the embodiment, when the mating connector is twisted upon extracting, it is possible to prevent the terminal 320 from coming off advertently from a housing 310, since the terminal 320 is held steadily with the locking portions 321A-2 and 321B-2.

In the embodiment, the locking portion 321B-2 and the pressing portion 321B-1 of the pressing arm portion 321 is provided by bending the pressing arm portion 321 into the convex shape in the thickness direction. The locking portion 321B-2 and the pressing portion 321B-1 may include protrusions, respectively. For example, the protrusions may be formed by embossing the plate surface of the pressing arm portion 321. Needless to say in this case, the protrusions of the pressing portion 321B-1 and the locking portion 321B-2 protrude toward the receiving recess portion 313 and the secondary side wall portion 311B, respectively.

The disclosure of Japanese Patent Application No. 2009-189151, filed on Aug. 18, 2009 is incorporated in the application by reference.

While the invention has been explained with reference to the specific embodiments of the invention, the explanation is illustrative and the invention is limited only by the appended claims.

What is claimed is:

1. An electrical connector to be connected to a mating connector, comprising:

a housing to be disposed on a circuit board;

a receiving recess portion formed in the housing for receiving the mating connector, said receiving recess portion being arranged between a first sidewall facing outside and a second sidewall situated inside relative to the first Sidewall and facing the first sidewall; and a terminal arranged in the housing, said terminal including a U-shape portion fitted in the receiving recess portion, an extending portion extending downwardly outside the receiving recess portion along and parallel with the first sidewall, and a connecting portion to be connected to the circuit board, said U-shape portion including a first arm portion extending along the first sidewall and a second arm portion extending along the second sidewall, said U-shape portion further including a first locking portion being arranged to bite into the first sidewall and a second locking portion being arranged to bite into the second sidewall when the terminal is attached to the housing and before the electrical connector is connected to the mating connector, said extending portion being arranged to be away from the first sidewall to form a space in between, said first locking portion and said second locking portion being arranged close to a bottom portion of the receiving recess portion; and wherein said first sidewall is arranged to deform toward outside when the electrical connector is connected to the mating connector.

2. The electrical connector according to claim 1, wherein said U-shape portion further includes a contacting portion at a distal end portion of the second arm portion for contacting a mating terminal of the mating connector, said first locking portion being disposed near a bottom portion of the U-shape portion.

3. The electrical connector according to claim 1, wherein said first locking portion is formed on the U-shape portion as a protrusion.

4. The electrical connector according to claim 1, wherein said first locking portion is formed on the first arm portion.

5. The electrical connector according to claim 1, wherein said second locking portion is formed on the second arm portion.

* * * * *